United States Patent [19]

Swenson

[11] Patent Number: 4,835,934

[45] Date of Patent: Jun. 6, 1989

[54] HEAVY-DUTY SPACER FOR REINFORCING MESH

[76] Inventor: Richard A. Swenson, 760 Norman Dr., Ridgewood, N.J. 07450

[21] Appl. No.: 214,946

[22] Filed: Jul. 5, 1988

[51] Int. Cl.[4] ..... E04C 5/16

[52] U.S. Cl. ..... 52/687; 52/677; 52/DIG. 1

[58] Field of Search ..... 52/652, 676–689, 52/712, DIG. 1

[56] References Cited

U.S. PATENT DOCUMENTS

| | | | |
|---|---|---|---|
| 918,716 | 4/1909 | Wedmore . | |
| 1,561,323 | 11/1925 | Gregg . | |
| 1,615,651 | 1/1927 | Reynolds et al. . | |
| 1,672,176 | 6/1925 | Schumacher | 52/687 |
| 1,959,633 | 5/1934 | Madden | 52/687 X |
| 2,299,490 | 8/1942 | Newman . | |
| 3,257,767 | 6/1966 | Lassy | 52/652 |
| 3,440,792 | 4/1969 | Schmidgall . | |
| 3,471,986 | 10/1969 | Swenson | 52/652 |
| 3,521,842 | 7/1970 | Opperthauser . | |
| 3,722,164 | 3/1973 | Schmidgall . | |
| 4,005,560 | 2/1977 | Simpson et al. . | |
| 4,152,256 | 5/1979 | Wennberg . | |
| 4,301,638 | 11/1981 | Schmidgall | 52/687 |
| 4,452,026 | 6/1984 | Tolliver . | |

FOREIGN PATENT DOCUMENTS 800499 10/1950 Fed. Rep. of Germany ..... 52/677

OTHER PUBLICATIONS

Hawkeye Catalogue, No. 182.

*Primary Examiner*—David A. Scherbel
*Assistant Examiner*—Richard E. Chilcot, Jr.
*Attorney, Agent, or Firm*—Brumbaugh, Graves, Donohue & Raymond

[57] ABSTRACT

A spacer for concrete wire reinforcement is comprised of a heavy gauge, flat metal spring steel band, having a hook at one end for receipt of one of two parallel wires of a wire mesh, and a curved and hook-like opposite end which can be resiliently forced into position under the second wire to securely retain the spacer in position. A generally V-shaped projection is provided on the spacer to position the wire mesh at the desired distance from the surface of the concrete mold. The apex of the projection is formed to have a convex wide-radius "ball-bearing" shape. This shape lends increased strength to the spacer and also results in a greatly reduced area of contact between the spacer projection and the mold wall. The spacer also includes a tail-like extension on the second hook-like opposite end, which extension coacts with a pronged tool during installation of the spacer on a wire mesh.

3 Claims, 1 Drawing Sheet

HEAVY-DUTY SPACER FOR REINFORCING MESH

BACKGROUND

1. Field of the Invention

The present invention relates to a spacer device for accurately locating and positioning wire reinforcement in molds for concrete structures, such as pipe, walls, slabs and the like. More particularly, it relates to a reinforcement spacer device which is of a high strength construction for heavy load applications.

2. The Prior Art

In the manufacture of reinforced concrete structures, such as concrete pipe, walls, slabs and the like, it is important that the steel reinforcement, typically in the form of welded-wire mesh, be properly positioned in the cross section of the designed structure. Improper positioning of the reinforcement degrades the structural integrity of the unit and, in a severe case, can lead to structural failure. Moreover, as labor skill and costs are significant factors in the manufacture of reinforced concrete structures, it is also important that the positioning of the reinforcement be carried out in as simple and straightforward, yet accurate, a manner as possible. A number of efforts have been made in the past to develop techniques and equipment that facilitate the correct placement of the steel reinforcement. Such efforts, however, have not fully addressed the problems involved nor provided solutions for those problems.

In the past, spacers provided have been composed of a light gauge metal band having opposite hook ends which were intended to engage parallel wires of the mesh. These spacers are sufficiently resilient to grip the wire mesh, yet light enough to allow "snap-on" application by hand. One such spacer is disclosed in the applicant's own U.S. Pat. No. 3,471,986, issued on Oct. 14, 1969.

The light-weight construction of the prior spacer, however, limits its use in heavy-duty applications, as it is susceptible of being dislodged or distorted in heavy-duty applications. In the case of concrete pipe, the device also is sometimes subject to side loads due to rotation of the mold around the reinforcing mesh, as the wall of the mold occasionally catches the edges of the spacer.

Another prior art spacer, described in U.S. Pat. No. 4,301,638, issued on Nov. 24, 1981, is a wire formed generally in a U-shape, providing parallel radial projections and duplicate pairs of hooks for clamping parallel wires of the mesh. The U-portion itself provides a looped lever arm for receiving a tool for forcibly applying the spacer to the wire mesh. While the device is stronger than those previously known, its hairpin-like structure permits the separate wire arms to deform relative to each other under side loading during radial compacting of the moist concrete, thus weakening the final product. Further, the hairpin structure with its loop tends to trap larger pieces of aggregate during concrete pouring, thereby inhibiting the free flow of concrete and creating voids, which weaken the structure of the final product.

Due to its U-shaped parallel wire structure, the '638 patent device is overly bulky, resulting in increased packing and shipping costs. As a matter of great practical inconvenience in the field, the hairpin-like structure results in the spacers becoming thoroughly entangled with each other during packing and shipment, which requires considerable time and labor to individually untangle the U-shaped spacers before they can be applied to the mesh wires. Still further, the duplicate hook and bight structure is complex and requires nearly exact parallelism, resulting in increased cost of manufacture.

SUMMARY OF THE INVENTION

The foregoing and other disadvantages of the prior art are overcome by the provision of a wire reinforcement spacer which is inexpensive to produce and of a simple and compact configuration, thus allowing for more streamlined and cost efficient packing, shipping, unpacking and application. It is of a heavy-duty construction so as to enable it to withstand high loads caused by the pouring of concrete into the mold as well as side loads caused by rotation of the mold. Still further, with regard to side load, the part of the projecting portion which contacts the wall possesses a wide-radius "ball bearing" shape, so that the spacer correctly positions the wire mesh at the desired distance from the wall while providing a substantially reduced contact surface, thereby eliminating catching and the resultant dislodgment of the spacer.

An additional advantage of the invention is that the simple compact configuration is conducive to the free flow of poured concrete and aggregate, thus leaving a final product essentially free of voids which would otherwise weaken the structure.

In a preferred embodiment, the invention comprises a simple, snap-on, resilient spacer which is sufficiently heavy-duty to withstand large loads and yet is easily attachable by use of a simple two-pronged lever. More particularly, a spacer formed in accordance with the present invention is of a heavy-gauge flat metal band of spring steel material, having a hook at one end which can be hooked over one of two parallel wires of a wire mesh, and a curved and hook-like opposite end which can be resiliently forced into position under the second wire to securely retain the spacer in position. A generally V-shaped projection is provided on the spacer to space the wire mesh at a desired distance from the wall of the mold by abutting the wall at the apex of the projection. The apex of the projection is machine-punched so as to obtain an outward wide-radius "ball-bearing" shape. This not only increases the strength of the spacer, but also results in a greatly reduced area of contact between the spacer projection and the wall. It additionally eliminates the edges of the spacer band present in prior art devices which tended to catch and cause dislodging of the spacer. These features of the ball-bearing apex greatly increase the effectiveness of the spacer of the present invention, as it is able to withstand greater side stress, caused, for example, by radial rotation of the mold about the mesh. The invention also resides in a tail-like extension of the second hook-like opposite end, which extension is adapted to coact with the pronged lever during application.

In accordance with the invention, therefore, a wire reinforcement spacer is provided which is heavy-duty, yet compact and simple in construction, does not entangle during packing and shipment, is easily and securely applied to wire mesh by means of a pronged tool, and, once applied, is able to withstand high levels of load stress without dislodging.

BRIEF DESCRIPTION OF THE DRAWINGS

For a better understanding of the invention, reference may be made to the following description of a representative embodiment thereof and to the accompanying drawings, in which.

DETAILED DESCRIPTION

For purposes of illustration, a representative embodiment of the invention is described hereinbelow in the context of the manufacture of precast reinforced concrete pipe. It will be understood, however, that the invention is not limited to that particular use, but has general application to the positioning of wire reinforcement in concrete or other cast structures.

Figure 2:
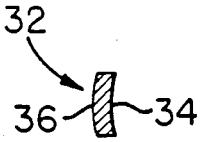
FIG. 2 is a view in section taken along line 2—2 of FIG. 1 and looking in the direction of the arrows.
Figure 3:
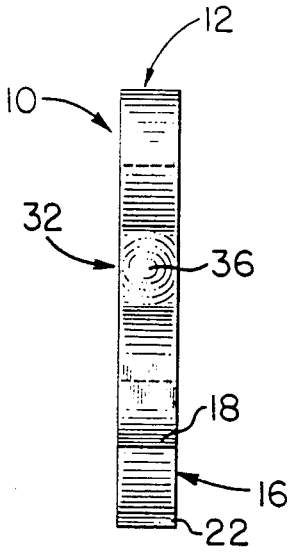
FIG. 3 is a front elevational view of the spacer of FIG. 1 taken along the line 3—3 of FIG. 1 and looking in the direction of the arrows.
Figure 4:
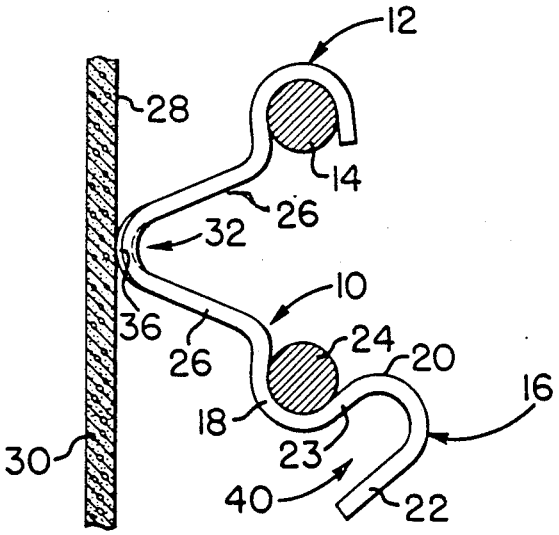
FIG. 4 is a part sectional, part elevational view of a spacer embodying the invention as applied to two parallel mesh wires and contacting a mold surface.

With reference first to FIGS. 1–4, a reinforcement spacer 10 constructed in accordance with the invention includes a hook-shaped end 12 which is adapted to be hooked over a first parallel wire 14 of a reinforcement mesh. The opposite end 16 of the spacer 10 is formed generally in an S-shape, including an upper concave rounded seat portion 18, a middle convex portion 20, and a terminal bent-back portion 22. The portion 22 is preferably extended for cooperation with an installation tool, as described hereinafter. To that end, the portion 22 is preferably parallel to the opposite side 23 of the S-shaped hook portion 16. As shown in FIG. 4, the concave seat portion 18 is adapted to receive a second parallel wire 24 of the mesh when the spacer 10 is installed on the mesh.

The spacer is preferably formed of flat stock and of hardened and tempered spring steel. For example, a suitable spacer may be manufactured from 0.100 inch×0.375 inch flat stock, C-1050, $R_B$80 hardened and tempered to $R_C$48 to 52. These dimensions and other properties may be varied as long as the spacer is of sufficient strength and resiliency for the purposes of the invention.

Between the two hook portions 12 and 16, the spacer 10 is formed into a generally V-shaped projection 26, the altitude of which determines the spacing of the wire mesh from the wall 28 of the mold 30 (see FIG. 4) by abutting the wall surface 28 at the apex 32 of the projection 26.

As shown in FIGS. 2 and 3, the apex 32, after being formed, is concavingly punched out, as at 34, to form a convex, wide-radius "ball-bearing" shaped surface 36. The surface 36 effectively presents a single rounded contact point for engagement with the wall surface 28. This not only has a self-centering effect, which tends to minimize tilting of the spacer, but also reduces the incidence of dislodgement of the spacer due to catching or biting of the spacer edges with or into the form wall 28.

Figure 1:
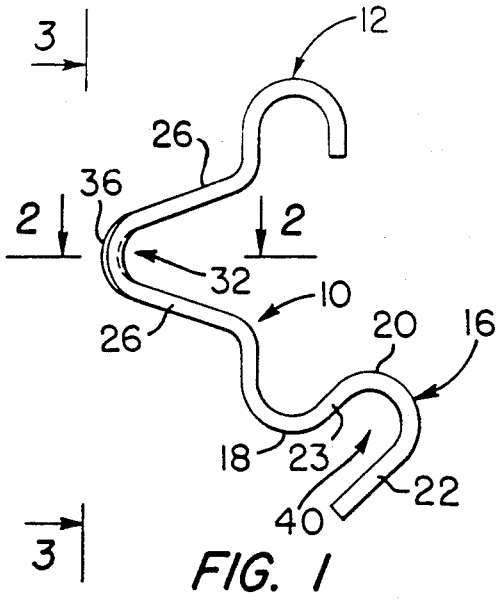
FIG. 1 is a side elevational view of a spacer embodying the invention.
Figure 6:
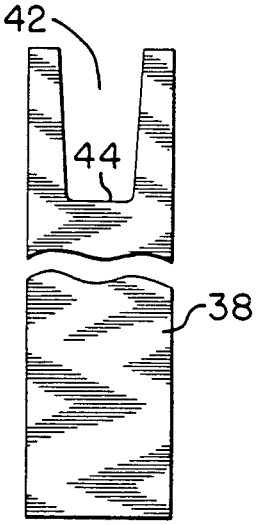
FIG. 6 is a plan view of the pronged tool shown in use in FIG. 5.
Figure 5:
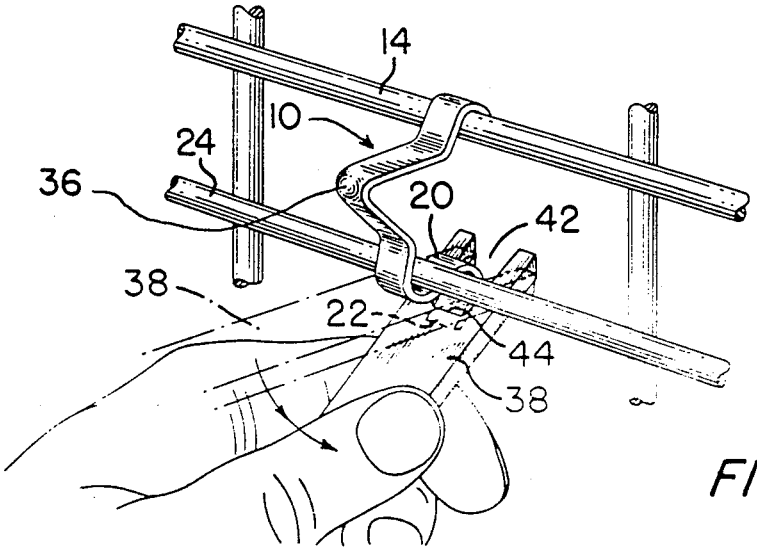
FIG. 5 is a perspective view showing a spacer embodying the invention being applied to wire mesh using a pronged tool.

With reference now to FIGS. 1 and 5, the extended terminal end 22 of the S-shaped portion 16 serves as an extended lever arm for coaction with a pronged tool 38 during installation of the spacer 10 on the wire mesh. The radius of the curved portion 20 is preferably selected to provide sufficient space 40 between the lever arm 22 and the opposing side 23 of hook 16 for the insertion of the tool 38. As shown in FIG. 6, the tool 38 may take the form of a simple elongated pry bar having a U-shaped notch 42 at one end. The tool 38 is preferably made from flat steel stock and should be of sufficient strength and length to permit the spacer 10 to be forced below the lower wire 24 against the resilience of the spacer.

During application of the spacer 10 to the wire mesh, the hook portion 12 is engaged around a first wire 14, so that when the spacer 10 hangs freely from the first wire 14 it contacts the second wire 24 at a point along the curved portion 20 slightly below the level of the seat 18. The pronged tool 38 is then inserted by hand in the receiving space 40 at a downward angle (as shown in dashed lines in FIG. 5) so that the prongs of the tool extend under the wire 24 and the terminal portion 22 of the spacer 10 is received within the groove 42 of the tool. As depicted in FIG. 5, the curved portion 20 acts as a stop for the base 44 of the groove 42 when the lever 38 is fully inserted into the space 40 between the lever arm 22 and the opposed parallel portion 23 of the spacer 10. The handle portion of the tool 38 is then pushed downward and inward towards the wire 24 (to the position as shown in solid lines in FIG. 5), so that the curved portion 20 of the spacer 10 is forced below the wire 24. This in turn allows the wire 24 to ride along the upper surface of the leg 23 and come to rest in the seat 18. The lever 38 is then removed from the space 40. The resilient character of the hardened and tempered spring material will securely lock the spacer 10 in place on the mesh.

The shape of the spacer is susceptible of modification within the scope of the invention. For example, instead of being sized to clamp over two adjacent parallel wires of the reinforcement mesh, the spacer could be extended, preferably in the region between the lower end of the projection 26 and the S-shaped hook portion 16, so as to clamp over the next lower parallel wire. In that case, the portion of the spacer just below the projection 26 could bear against the intermediate wire for additional supporting strength under stress. All such variations and modifications, therefore, are intended to be included within the spirit and scope of the appended claims.

I claim:

1. A spacer for positioning in spaced apart relation to a surface a wire reinforcement mesh including spaced parallel wires, comprising an elongate unitary member of relatively stiff heavy gauge flat metal band spring steel material having at one end thereof hook means for receiving a first wire of the reinforcing mesh, and having at the other end thereof a generally S-shaped portion including a concave surface defining a seat for gripping a second, substantially parallel wire of the reinforcing mesh and terminating in a generally U-shaped portion; the member being positionable with its length crosswise to the first and second mesh wires and extending therebetween as a single leg; means defining a convex curved surface on the member adjacent the concave surface, the convex curved surface projecting relative to the seat of the concave surface towards said one end of the member and being adapted to be resiliently lowered relative to said one end by an applied force, so that the second mesh wire rides along the convex curved surface and rests in the seat of the concave surface; an extending part of the U-shaped portion forming a lever arm, the lever arm defining with the opposed leg of the U-shaped portion a receiving space for a conforming force-applying tool, which lever arm is capable of withstanding a force applied by the tool necessary to resiliently lower the convex curved surface below the second mesh wire; and a projection on the member extending substantially normal to the mesh when the first and second wires are securely engaged by the hook means and the seat, respectively, and forming an apex, which apex acts to abut said surface spaced apart from the wire mesh and which apex has a relatively wide radius, ball-bearing shape to provide a substantially point contact between the apex and said surface.

2. The spacer of claim 1 wherein the lever arm is essentially parallel to said opposed leg of the U-shaped portion.

3. The spacer of claim 1 wherein the wide radius, ball-bearing shape of the apex is formed by machine-punching at the concave surface of the apex.

* * * * *